US008490771B2

(12) United States Patent
Toji

(10) Patent No.: US 8,490,771 B2
(45) Date of Patent: Jul. 23, 2013

(54) COIN RECOGNITION APPARATUS AND COIN RECOGNITION METHOD

(75) Inventor: Kazuo Toji, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 129 days.

(21) Appl. No.: 13/128,293

(22) PCT Filed: Nov. 10, 2008

(86) PCT No.: PCT/JP2008/070416

§ 371 (c)(1),
(2), (4) Date: May 9, 2011

(87) PCT Pub. No.: WO2010/052798

PCT Pub. Date: May 14, 2010

(65) Prior Publication Data

US 2011/0209967 A1 Sep. 1, 2011

(51) Int. Cl.
*G07D 5/08* (2006.01)

(52) U.S. Cl.
USPC ..... 194/319; 194/317

(58) Field of Classification Search
USPC ..... 194/317, 318, 319, 320; 702/75, 702/76, 77, 79, 81, 82; 73/163
See application file for complete search history.

(56) References Cited

U.S. PATENT DOCUMENTS

| | | | |
|---|---|---|---|
| 6,892,871 | B2 | 5/2005 | Strauts et al. |
| 6,988,606 | B2 * | 1/2006 | Geib et al. ..... 194/334 |
| 7,552,810 | B2 | 6/2009 | Mecklenburg |
| 2003/0168310 | A1 | 9/2003 | Strauts et al. |

FOREIGN PATENT DOCUMENTS

| | | | |
|---|---|---|---|
| GB | 2 323 199 | A | 9/1998 |
| JP | 6-96324 | | 4/1994 |
| JP | HEI 06-096324 | A | 4/1994 |
| JP | 8-44926 | | 2/1996 |
| JP | HEI 08-44926 | A | 2/1996 |
| JP | 10-334299 | | 12/1998 |
| JP | HEI 10-334299 | A | 12/1998 |
| JP | 3995423 | | 10/2007 |

OTHER PUBLICATIONS

European Search Report (Application No. 08877993.9—PCT/JP2008070416) (6 pages—dated Mar. 23, 2012).

* cited by examiner

*Primary Examiner* — Mark Beauchaine

(74) *Attorney, Agent, or Firm* — Renner, Kenner, Greive, Bobak, Taylor & Weber

(57) ABSTRACT

In a coin recognition apparatus, when an oscillator control unit applies a synthesized signal containing signals of a plurality of designated frequencies to an oscillator coil, an AD (Analog-to-Digital) converting unit converts an output signal from a receiving coil into a digital signal. A frequency expansion unit expands the digital signal on a frequency axis. A coin recognition unit recognizes a coin based on an amplitude of each signal of the designated frequency extracted from the expanded signal. Furthermore, if the coin recognition apparatus detects a coin center, which is a substantially central line on a surface of the coin, has reached a magnetic sensor based on the output signal from the receiving coil when a single frequency signal is applied to the oscillator coil, the synthesized signal is applied to the oscillator coil.

5 Claims, 10 Drawing Sheets

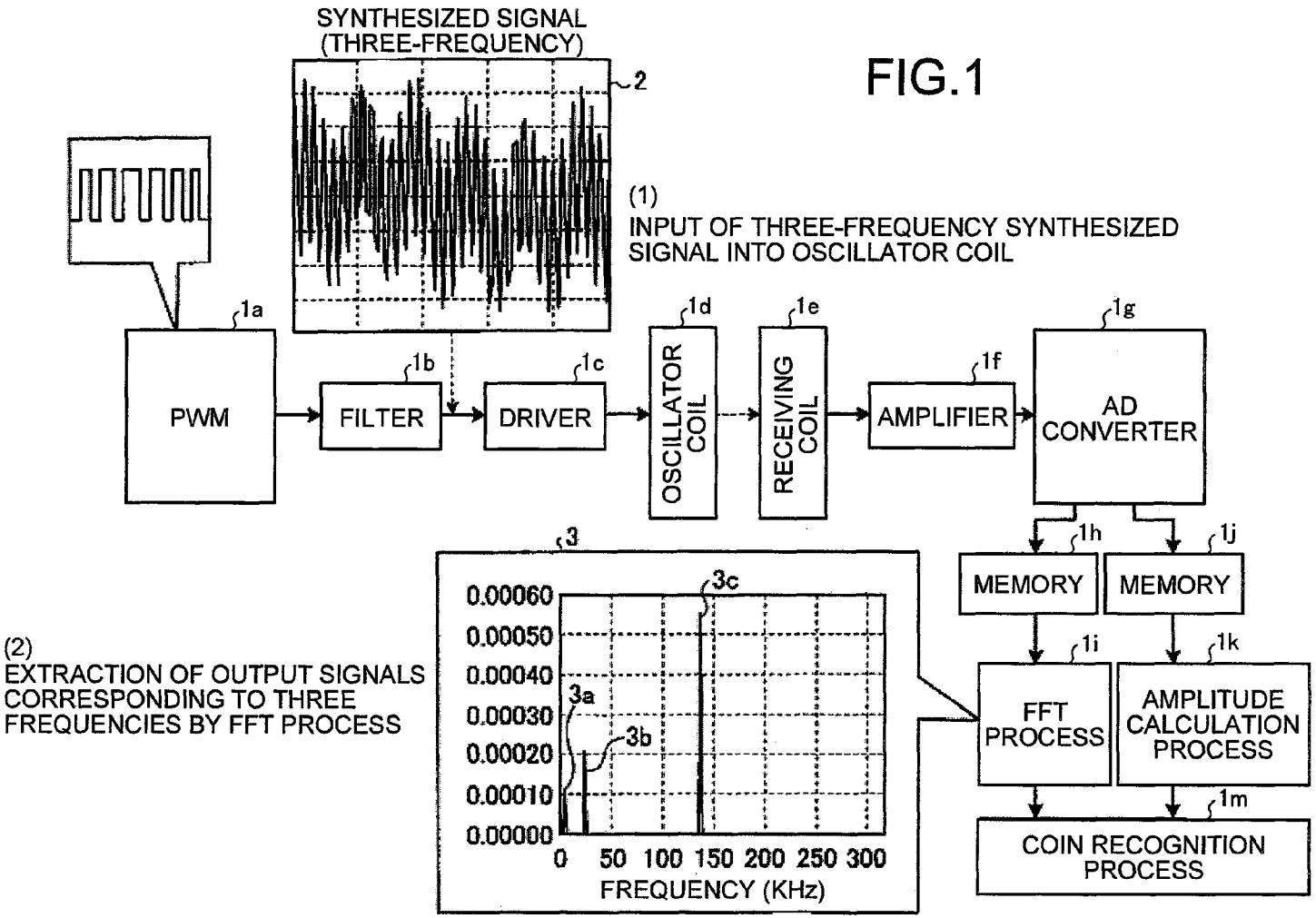
FIG.1
SYNTHESIZED SIGNAL (THREE-FREQUENCY)
2
(1) INPUT OF THREE-FREQUENCY SYNTHESIZED SIGNAL INTO OSCILLATOR COIL
1a
PWM
1b
FILTER
1c
DRIVER
1d
OSCILLATOR COIL
1e
RECEIVING COIL
1f
AMPLIFIER
1g
AD CONVERTER
1h
MEMORY
1i
FFT PROCESS
1j
MEMORY
1k
AMPLITUDE CALCULATION PROCESS
1m
COIN RECOGNITION PROCESS
3
3a
3b
3c
0.00060
0.00050
0.00040
0.00030
0.00020
0.00010
0.00000
0 50 100 150 200 250 300
FREQUENCY (KHz)
(2) EXTRACTION OF OUTPUT SIGNALS CORRESPONDING TO THREE FREQUENCIES BY FFT PROCESS

FIG.4

| COIL CATEGORY | COIL NAME | FREQUENCY | PARAMETER TO BE MEASURED |
|---|---|---|---|
| OSCILLATOR COIL | OSCILLATOR COIL | 4069 Hz | CURRENT |
| | | 22380 Hz | |
| | | 128174 Hz | |
| RECEIVING COIL | TRANSMISSIVE ONE-SIDE ALIGNING COIL | 4069 Hz | VOLTAGE |
| | | 22380 Hz | |
| | | 128174 Hz | |
| | TRANSMISSIVE COUNTER-SIDE ALIGNING COIL | 4069 Hz | VOLTAGE |
| | | 22380 Hz | |
| | | 128174 Hz | |
| | REFLECTIVE COIL | 4069 Hz | VOLTAGE |
| | | 22380 Hz | |
| | | 128174 Hz | |

COIN RECOGNITION APPARATUS AND COIN RECOGNITION METHOD

CROSS-REFERENCE TO RELATED APPLICATION

This application is the National Stage of International Application No. PCT/JP2008/070416, filed on Nov. 10, 2008.

TECHNICAL FIELD

The present invention relates to a coin recognition apparatus and a coin recognition method that recognize a coin by detecting a signal that is induced in a receiving coil due to a magnetic field generated by passing a current through an oscillator coil. More particularly, the present invention relates to a coin recognition apparatus and a coin recognition method by which coin recognition can be performed quickly and with a high accuracy without having to increase a scale of a circuitry.

BACKGROUND ART

Coin recognition apparatuses that transport coins by a transporting mechanism and perform recognition of a denomination and/or authenticity of each coin by a magnetic sensor including an oscillator coil and a receiving coil that are arranged across a transport path from each other are known in the art.

For example, a technology for recognizing a coin is disclosed in Patent Document 1. In this technology, a synthesized signal containing signals of a plurality of frequencies is applied to an oscillator coil as an input signal, a signal that is induced in a receiving coil is output from a receiving side as an output signal, and coin recognition is performed based on comparison of the input signal and the output signal.

Specifically, an oscillation signal of a high frequency (for example, 250 kilohertz (kHz)), an oscillation signal of a medium frequency (for example, 16 kHz), and an oscillation signal of a low frequency (for example, 4 kHz) are synthesized and applied to the oscillator coil.

On the receiving side, the high frequency signal (for example, 250 kHz) in the signal that is induced in the receiving coil is separated by using a first filter, the medium frequency signal (for example, 16 kHz) is separated by using a second filter, and the low frequency signal (for example, 4 kHz) is separated by using a third filter.

Then, the signals of each frequency (250 kHz, 16 kHz, and 4 kHz) contained in the synthesized wave are extracted. The signals of each of the frequencies (250 kHz, 16 kHz, and 4 kHz) on the receiving side and the transmitting side are compared each other, and recognition of the denomination and/or authenticity of the coin are performed based on attenuation characteristics of the signals.

[Patent document 1] Japanese Patent No. 3995423

DISCLOSURE OF INVENTION

Problem to be Solved by the Invention

The technology disclosed in Patent Document 1 is disadvantageous in that it entails an increase in the scale of a circuitry of the coin recognition apparatus. Specifically, on the receiving side, each receiving coil needs as many filters as the number of frequencies of signals to be extracted, and if the receiving coils are of various types, a large number of filters need to be prepared.

Meanwhile, to perform the coin recognition based on the fact that the output signal output from the receiving coil changes with the passage of the coin being transported, with a high accuracy, the output signal should preferably be obtained at a timing when a center of the coin being transported coincides with a center of the sensor.

In the conventional technology, however, since changes in the output signal from the receiving coil are recorded, and ex-post estimation of the timing when the center of the coin is likely to coincide with the center of the sensor is made based on the recorded result, the processes cause a delay in the coin recognition.

Due to the reasons stated above, it is a major challenge to realize a coin recognition apparatus, or a coin recognition method, whereby the coin recognition can be performed quickly and with a high accuracy without having to increase the scale of the circuitry.

It is an object of the present invention to provide a solution to the problems presented by the conventional technology, and provide a coin recognition apparatus and a coin recognition method by which the coin recognition can be performed quickly and with a high accuracy without having to increase the scale of the circuitry.

Means for Solving Problem

To solve the above problems and to achieve the above objects, a coin recognition apparatus according to an aspect of the present invention performs recognition of a coin being transported by using a magnetic sensor that detects a signal that is induced in a receiving coil due to a magnetic field generated by passing a current through an oscillator coil. The coin recognition apparatus includes a synthesized signal applying unit that applies to the oscillator coil a synthesized signal containing signals of a plurality of designated frequencies; an expansion unit that converts an output signal, which is a signal output from the receiving coil when the synthesized signal is applied to the oscillator coil by the synthesized signal applying unit, into a digital signal and expands the digital signal on a frequency axis; and a recognizing unit that performs recognition of the coin based on amplitudes of the signals of the designated frequencies extracted from the signals expanded by the expansion unit.

Furthermore, according to another aspect, the coin recognition apparatus further includes a coin center detecting unit that detects whether a coin center, which represents a substantially central line on a surface of the coin, has reached the magnetic sensor based on the output signal output from the receiving coil when a single-frequency signal is applied to the oscillator coil, wherein the synthesized signal applying unit applies the synthesized signal to the oscillator coil when the coin center is detected by the coin center detecting unit.

Moreover, according to still another aspect, in the coin recognition apparatus, a clock that generates the signals of the designated frequencies applied to the oscillator coil and a clock that converts the output signal from the receiving coil to the digital signal are generated from one and the same clock.

Furthermore, according to still another aspect, in the coin recognition apparatus, the signals of the designated frequencies contained in the synthesized signal have component frequencies that are not integer multiples of each other.

Moreover, according to still another aspect, in the coin recognition apparatus, the recognizing unit performs recognition of the coin based on an output signal output from the receiving coil corresponding to a single-frequency signal used by the coin center detecting unit.

A coin recognition method according to still another aspect is a method for performing recognition of a coin being transported by using a magnetic sensor that detects a signal that is induced in a receiving coil due to a magnetic field produced by passing a current through an oscillator coil. The coin recognition method includes applying a synthesized signal containing signals of a plurality of designated frequencies to the oscillator coil; converting an output signal, which is a signal output from the receiving coil when the synthesized signal is applied to the oscillator coil at the applying, into a digital signal and expanding the digital signal on a frequency axis; and recognizing the coin based on amplitudes of the signals of the designated frequencies extracted from the signals expanded at the expanding.

Advantages of the Invention

According to an aspect of the present invention, a synthesized signal containing signals of a plurality of designated frequencies is applied to an oscillator coil, an output signal output from a receiving coil when the synthesized signal is applied to the oscillator coil is converted to a digital signal and expanded on a frequency axis, and a coin is recognized based on amplitudes of the signals of the designated frequencies extracted from the expanded signals. Consequently, a coin recognition process can be performed without having to increase a scale of a circuitry.

According to another aspect of the present invention, the fact that a coin center, which represents a substantially central line on a surface of the coin, has reached a magnetic sensor is detected based on the output signal from the receiving coil when a single-frequency signal is applied to the oscillator coil. When the coin center is detected, the synthesized signal is applied to the oscillator coil. Consequently, an accuracy of coin recognition can be improved by obtaining information based on the synthesized signal from the coin center where an accuracy of the coin recognition is highest.

According to still another aspect of the present invention, a clock that generates the signals of the designated frequencies applied to the oscillator coil and a clock that converts the output signal from the receiving coil into the digital signal are generated from one and the same clock. Consequently, by using clocks derived from the same reference clock on both the oscillator and the receiving side, a mismatch in operation times on the oscillator and the receiving side due to lack of synchronization of the clocks can be prevented.

According to still another aspect of the present invention, the signals of the designated frequencies contained in the synthesized signal have frequencies that are not integer multiples of each other. Consequently, noise due to signal interference can be reduced.

According to still another aspect of the present invention, recognition of the coin is performed based on the output signal from the receiving coil corresponding to the single-frequency signal. Thus, the accuracy of coin recognition can be improved by using a recognition element based on a single-frequency application in addition to a recognition element based on a synthesized-frequency application.

BRIEF DESCRIPTION OF DRAWINGS

FIG. 1 is a schematic diagram for explaining a coin recognition method according to the present invention.

FIG. 4 is a drawing of an oscillator coil and a receiving coil.

EXPLANATIONS OF LETTERS OR NUMERALS

Figure 2:
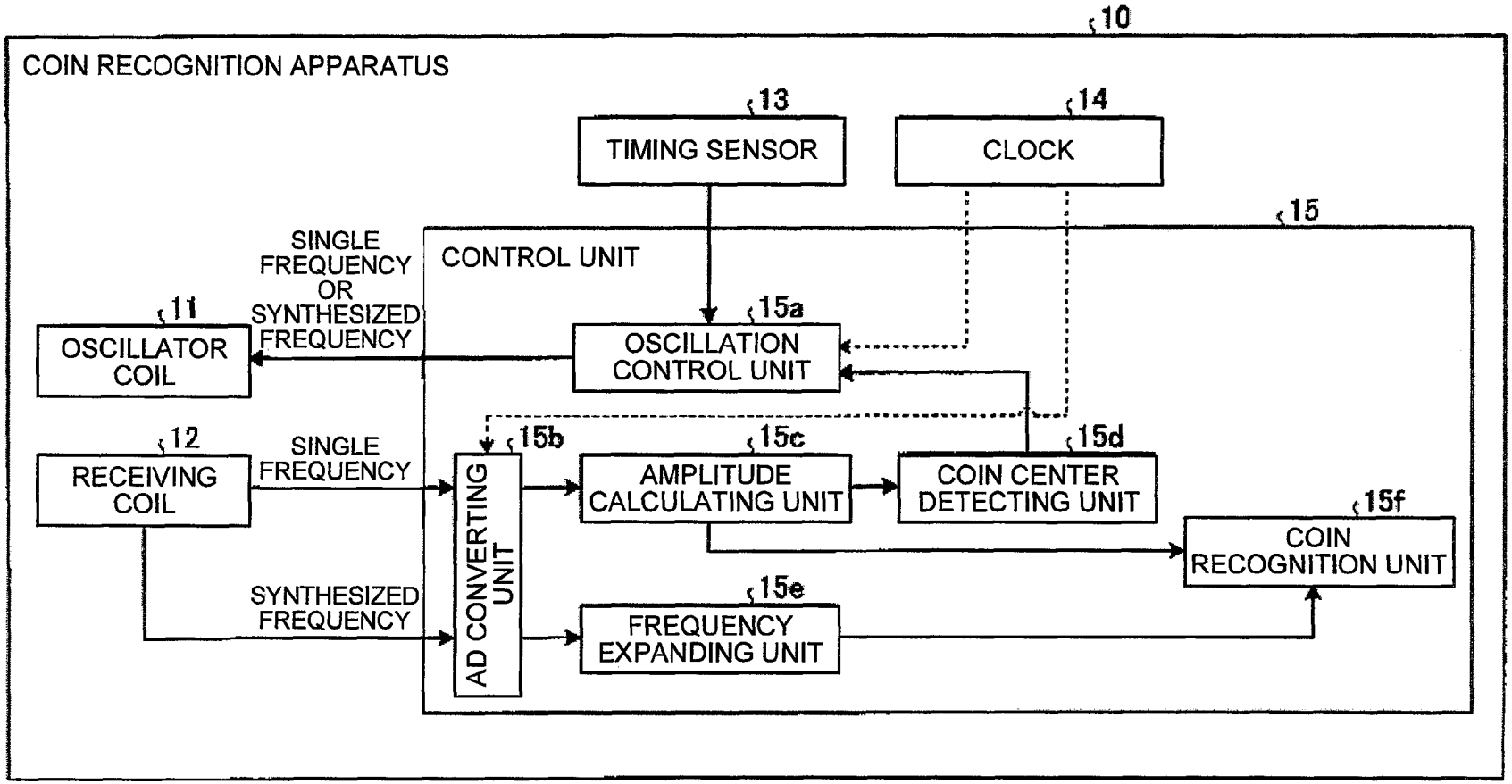
FIG. 2 is a block diagram of a coin recognition apparatus according to an embodiment of the present invention.

10: Coin recognition apparatus
11: Oscillator coil
12: Receiving coil
13: Timing sensor
14: Clock
15: Control unit
15*a*: Oscillator control unit
15*b*: AD (Analog-to-Digital) converting unit
15*c*: Amplitude calculating unit
15*d*: Coin center detecting unit
15*e*: Frequency expansion unit
15*f*: Coin recognition unit
30*a* and 30*b*: Lateral side
31: Oscillator coil
31*a* and 31*b*: Core
32: Transmissive one-side aligning coil
32*a*: Core
32*b*: Coil
33: Transmissive counter-side aligning coil
33*a*: Core
33*b*: Coil
34: Reflective coil
34*a*: Core side coil
51: Transport pin
101: Coin

BEST MODE(S) FOR CARRYING OUT THE INVENTION

Exemplary embodiments of a coin recognition apparatus and a coin recognition method according to the present invention are explained in detail below with reference to the accompanying drawings. The coin recognition method is explained first, followed by the explanation of the coin recognition apparatus.

Figure 10:
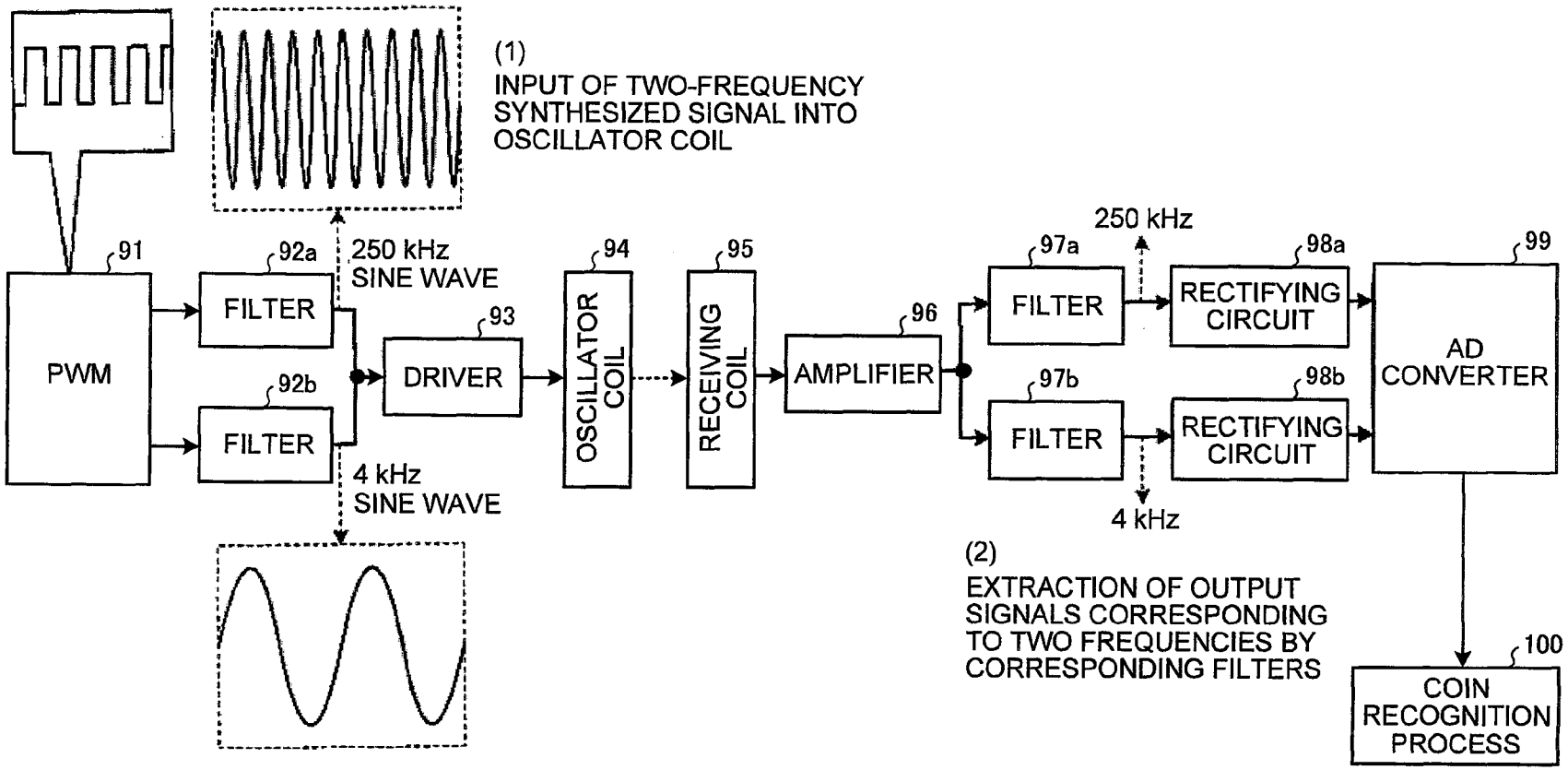
FIG. 10 is a schematic diagram of an overview of a coin recognition method according to the conventional technology.

An overview of a coin recognition method according to a conventional technology is given first for clear understanding of salient features of the coin recognition method according to the present invention. FIG. 10 is a schematic diagram of an overview of the coin recognition method according to the conventional technology. A PWM (Pulse Width Modulator) 91 shown in FIG. 10 is a device that outputs a rectangular wave of arbitrary frequency by performing pulse width modulation.

In the coin recognition method according to the conventional technology, as shown in FIG. 10, a signal output from the PWM 91 is input into a driver 93 as a sine wave of 250 kHz through a filter 92*a*, and as a sine wave of 4 kHz through a filter 92*b*.

The driver 93 combines the sine wave of 250 kHz and the sine wave of 4 kHz and applies the combined sine wave to an oscillator coil 94. In a receiving coil 95, an induced signal is amplified by an amplifier 96. A filter 97*a* extracts a signal corresponding to the sine wave of 250 kHz from the amplified signal, and a filter 97*b* extracts a signal corresponding to the sine wave of 4 kHz.

Next, a rectifying circuit 98*a* converts the signal output from the filter 97*a* into a direct voltage signal, while a rectifying circuit 98*b* converts the signal output from the filter 97*b* into a direct voltage signal. An AD (Analog-to-Digital) converter 99 converts the direct voltage signals output from the filters 97*a* and 97*b* into digital signals. Finally, a coin recognition process 100 is performed based on the digital signals output from the AD converter 99.

Thus, in the coin recognition method according to the conventional technology, a synthesized signal containing signals of two frequencies is input into the oscillator coil 94 (see (1) of FIG. 10), and from the signal that is induced in the receiving coil 95, output signals of the two frequencies are extracted by different filters (filters 97*a* and 97*b*). The signals extracted from the filters 97*a* and 97*b* are rectified by the rectifying circuits 98*a* and 98*b*, respectively.

Thus, in the coin recognition method according to the conventional technology, a filter and a rectifying circuit need to be provided downstream of the receiving coil 95 for each frequency to be extracted, leading to an increase in the scale of the circuitry. Furthermore, in the coin recognition method according to the conventional technology, signal delay occurs in the rectification process undertaken by the rectifying circuits.

To determine the denomination and/or authenticity of a coin with a high accuracy, signals of several frequencies that can reflect the characteristics of the coin should preferably be used. However, as the number of frequencies is increased, the number of filters on the downstream of the receiving coil 95 also needs to be correspondingly increased. If a plurality of coils, such as a transmissive coil and a reflective coil, are used as the receiving coil 95, the number of filters on the downstream of the receiving coil 95 needs to be increased corresponding to the number of the coils.

To solve this problem, in the coin recognition method according to the present invention, the frequencies are extracted from the receiving coil by a fast Fourier transform process (FFT process). FIG. 1 is a schematic diagram for explaining the coin recognition method according to the present invention. In the coin recognition method according to the present invention, as shown in FIG. 1, a PWM 1*a* outputs a pulse width signal containing signals of three frequencies. A filter 1*b* converts the pulse width signal to an oscillation signal (see reference numeral 2 of FIG. 1), and inputs the same to a driver 1*c*. The driver 1*c* inputs the synthesized signal received from the filter 1*b* to an oscillator coil 1*d*.

Specifically, the filter 1*b* performs a process of converting differences in pulse widths in a pulse train received from the PWM 1*a* into voltage variations. That is, the filter 1*b* performs an FV (Frequency to Voltage) conversion. Although the PWM 1*a* and the filter 1*b* are used for obtaining the synthesized signal in the present embodiment, a DA converter can be used to obtain the synthesized signal.

Furthermore, an induced signal in a receiving coil 1*e* is amplified by an amplifier 1*f* before it is input into an AD (Analog-to-Digital) converter 1*g*. The synthesized signal output from the AD converter 1*g* is stored in a memory 1*h* before being subjected to an FFT process 1*i*, and expanded on a frequency axis (see reference numeral 3 of FIG. 1). Thus, as shown in FIG. 1, the signals of all the frequencies (3*a*, 3*b*, and 3*c* in FIG. 3) contained in the synthesized signal are expanded by the FFT process 1*i*.

That is, in the coin recognition method according to the present invention, the synthesized signal containing the signals of three frequencies is input into the oscillator coil 1*d* (see (1) of FIG. 1). The output signals corresponding to the three frequencies are extracted by the FFT process (Fast Fourier Transform process) (see (2) of FIG. 1) on the side of the receiving coil 1*e*. Thus, by using the FFT process for extracting the signals, the scale of the circuitry can be kept from increasing in the present invention. Furthermore, because no rectifying circuit is required, no signal delay due to rectification process occurs.

Furthermore, in the coin recognition method according to the present invention, a timing when a center of the coin being transported coincides with a center of a sensor is detected based on an amplitude attenuation of a single-frequency signal (see memory 1*j* and amplitude calculation process 1*k* of FIG. 1). Moreover, a coin recognition process 1*m* is performed based on an output of the FFT process 1*i* by which the three frequencies are extracted, and an output of attenuation of a single-frequency signal related to the amplitude obtained from the amplitude calculation process 1*k*. The coin recognition process 1*m* is explained later.

An embodiment of the coin recognition apparatus in which the coin recognition method according to the present invention is implemented is explained below. In the present embodiment, signals of three frequencies have been used for forming a synthesized signal; however, using even four or more frequencies will not lead to an increase in the scale of the circuitry.

Embodiment

FIG. 2 is a block diagram of a coin recognition apparatus 10 according to the present embodiment. As shown in FIG. 2, the coin recognition apparatus 10 includes an oscillator coil 11, a receiving coil 12, a timing sensor 13, a clock 14, and a control unit 15. The control unit 15 includes an oscillation control unit 15*a*, an AD (Analog-to-Digital) converting unit 15*b*, an amplitude calculating unit 15*c*, a coin center detecting unit 15*d*, a frequency expansion unit 15*e*, and a coin recognition unit 15*f*.

The oscillator coil 11 is a primary coil to which a single frequency or a synthesized frequency is applied based on an instruction from the oscillation control unit 15*a* of the control unit 15. The receiving coil 12 is a secondary coil that generates a voltage as a result of being induced by the signal applied to the oscillator coil 11. The oscillator coil 11 and the receiving coil 12 are explained in further detail with reference to FIG. 3 and FIG. 4, respectively.

Figure 3:
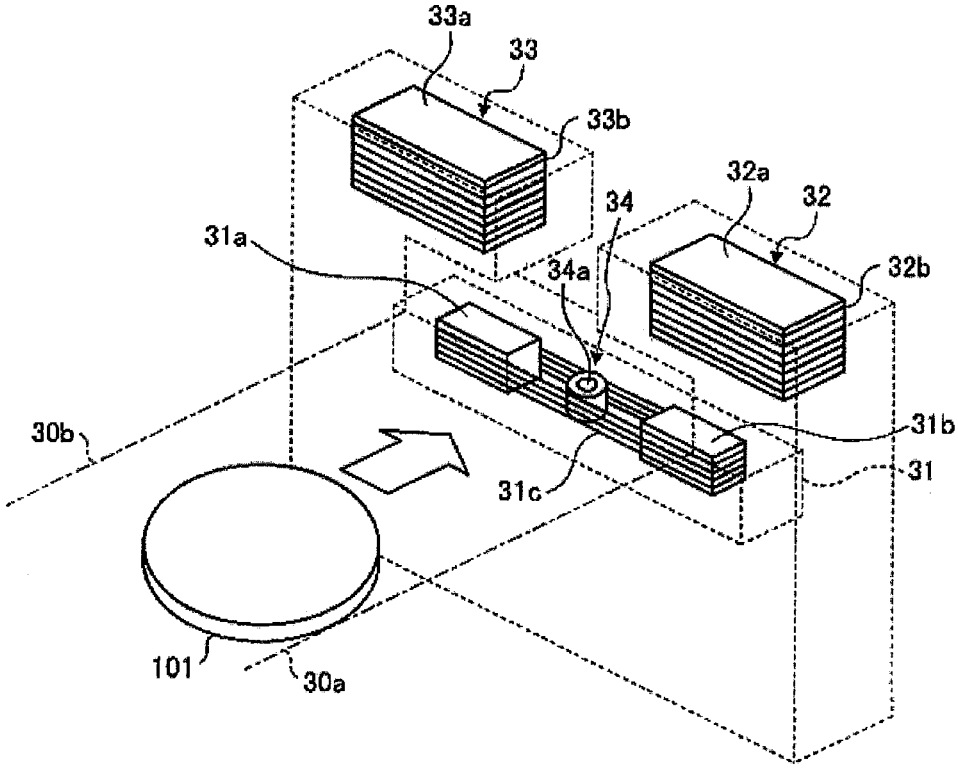
FIG. 3 is a drawing depicting an arrangement of coils.

FIG. 3 is a drawing depicting an arrangement of the coils. In FIG. 3, reference numerals 30*a* and 30*b* denote lateral sides of a transport path. A coin 101 is transported while being one side-aligned to the lateral side 30*a* in the direction of an arrow shown in FIG. 3.

As shown in FIG. 3, a transmissive one-side aligning coil 32 and a transmissive counter-side aligning coil 33 that correspond to transmissive coils are arranged at positions facing an oscillator coil 31, and the transport path is therebetween. The term transmissive coil refers to the coils arranged above a surface of the transport path facing the oscillator coil 31.

The transmissive one-side aligning coil 32 is arranged at a position amenable to detecting a coin edge of the coin 101 that is in contact with the lateral side 30*a*. The transmissive counter-side aligning coil 33 is arranged at a position amenable to detecting the other edge of the coin 101, regardless of denomination, that is separated from the lateral side 30*b* by a certain distance.

The transmissive one-side aligning coil 32 includes a core 32*a* around which a coil 32*b* is wound. Similarly, the transmissive counter-side aligning coil 33 includes a core 33*a* around which a coil 33*b* is wound.

The oscillator coil 31 includes a coil 31*c* wound around the core 31*a* and core 31*b* that are arranged apart from each other. A reflective coil 34 is arranged inside the coil 31*c* between the cores 31*a* and 31*b* of the oscillator coil 31.

The reflective coil 34 includes a core side coil 34*a* that corresponds to a secondary coil wound around a core that corresponds to a central axis. Similar to the oscillator coil 31, the reflective coil 34 abuts against the surface of the transport path.

Thus, the oscillator coil 31 corresponds to the primary coil, whereas the transmissive one-side aligning coil 32, the transmissive counter-side aligning coil 33, and the core side coil 34*a* of the reflective coil 34 correspond to the secondary coil.

The oscillator coil (primary coil) and the receiving coil (secondary coil) are explained with reference to FIG. 4. FIG. 4 is a drawing of the oscillator coil and the receiving coil. When the coils shown in FIG. 3 are categorized into an oscillator coil and a receiving coil, as shown in FIG. 4, the oscillator coil 31 would fall under the oscillator coil category, and the transmissive one-side aligning coil 32, the transmissive counter-side aligning coil 33, and the core side coil 34*a* of the reflective coil 34 would fall under the receiving coil category.

The synthesized wave containing, for example, signals of frequencies 4069 hertz (Hz), 22380 Hz, and 128174 Hz is applied to the oscillator coil 31. In the coin recognition apparatus 10 according to the present embodiment, a current flowing in the oscillator coil 31 is measured, and added to a recognition element in the coin recognition process.

The signals corresponding to the frequencies 4069 Hz, 22380 Hz, and 128174 Hz contained in the synthesized signal wave applied to the oscillator coil 31 are induced in the transmissive one-side aligning coil 32, the transmissive counter-side aligning coil 33, and the reflective coil 34. In the coin recognition apparatus 10 according to the present embodiment, voltages produced in the transmissive one-side aligning coil 32, the transmissive counter-side aligning coil 33, and the reflective coil 34 are measured and added to the recognition element in the coin recognition process.

Although the signals of the frequencies 4069 Hz, 22380 Hz, and 128174 Hz are shown in FIG. 4, signals of other frequencies can be used as long as the frequencies are not integer multiples of each other, and are amenable to detecting the characteristics of the coin. Alternatively, instead of using the designated frequencies shown in FIG. 4, a frequency ratio of each signal can be determined, and signals of each frequency can be generated based on a reference clock supplied by the clock 14.

Returning to FIG. 2, the timing sensor 13 is explained next. The timing sensor 13 is provided further upstream of the oscillator coil 11 and the receiving coil 12 in the transport path, and includes, for example, a photoemitter and a photodetector that are provided across the transport path from each other. The timing sensor 13 detects proximity of the coin based on the photodetector detecting the light from the photoemitter being blocked by the coin.

The clock 14 is a basic clock based on which the oscillator control unit 15*a* and the AD converting unit 15*b* operate. The timing of each processing unit is determined based on multiples of the reference clock generated by the clock 14.

A mismatch in the operation timings of different processing units due to being in operation based on different reference clocks can be avoided by operating the oscillator control unit 15*a* and the AD converting unit 15*b* based on the reference clock generated by the clock 14. Thus, an induced signal of the same frequency as the frequency applied to the oscillator coil 11 can be obtained in the receiving coil 12 even if there is a frequency deviation in the reference clock.

The control unit 15 controls switching of the signal applied to the oscillator coil 11 between a single-frequency signal and a synthesized-frequency signal, and performs functions additionally as a processing unit that performs coin recognition based on the induced signal, in the receiving coil 12, including an output corresponding to the single-frequency signal and an output corresponding to the synthesized-frequency signal.

Figure 5:
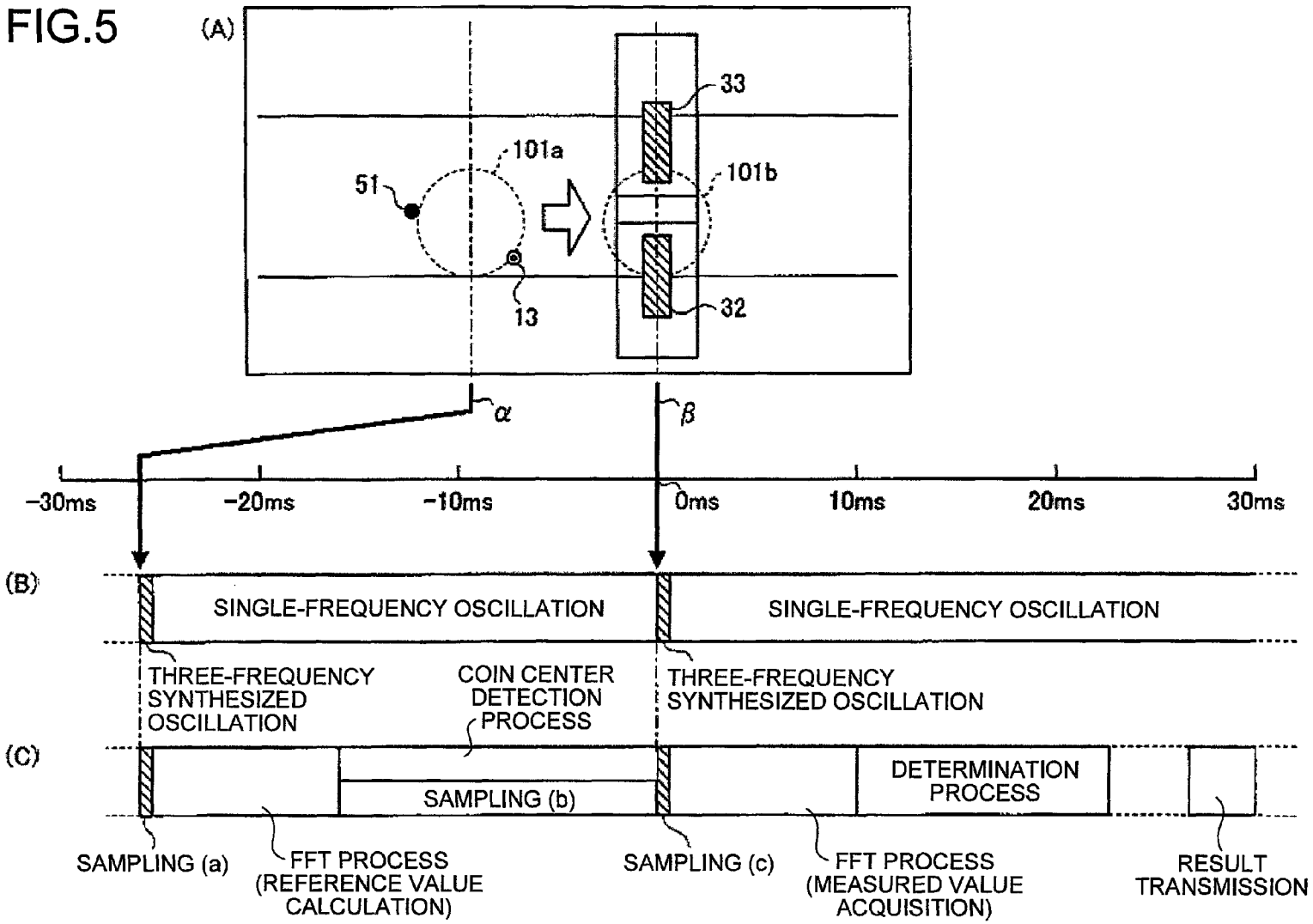
FIG. 5 is a drawing depicting an overview of the process procedure performed by a control unit.

An overview of the process procedure performed by the control unit 15 is explained with reference to FIG. 5. FIG. 5 is a drawing depicting the overview of the process procedure performed by the control unit 15. The part of FIG. 5 denoted by a reference symbol (A) is a view of a magnetic sensor shown in FIG. 3 as seen from a direction orthogonal to the transport path surface, a reference symbol (B) denotes a timing chart of signals applied to the oscillator coil 11, and a reference symbol (C) denotes timing charts of each process based on the signal that is induced in the receiving coil 12.

As shown in (A) in FIG. 5, at a timing when the coin 101 supported by a transport pin 51 reaches a position indicated by a reference symbol 101*a*, that is, at a timing when the coin 101 reaches the position of the timing sensor 13 (see reference symbol a in (A) of FIG. 5), the oscillator coil 11 performs, as shown in (B) of FIG. 5, a three-frequency synthesized oscillation based on an instruction from the oscillator control unit 15*a*.

A sampling (a) is performed in the receiving coil 12, as shown in (c) of FIG. 5. Thereafter, the frequency expansion unit 15*e* performs the FFT process on data collected in the sampling (a). An amplitude value of each designated frequency calculated in the FFT process is used as a reference value in the absence of the coin 101 at the positions where the oscillator coil 11 and the receiving coil 12 are installed.

As shown in (B) of FIG. 5, when the three-frequency synthesized oscillation ends in the oscillator coil 11, a single-frequency oscillation is performed based on the instruction from the oscillator control unit 15*a*. At the same time, as shown in (C) of FIG. 5, in the receiving coil 12, a coin center detection process is performed by the coin center detecting unit 15*d*. The coin center detection process is performed based on data collected in a sampling (b) implemented concurrently.

As shown in (A) of FIG. 5, when the coin center detecting unit 15*d* detects that the coin 101 has reached a position denoted by a reference symbol 101*b* in (A) of FIG. 5, that is, at a timing when a coin center coincides with a sensor center (see reference symbol β in (A) of FIG. 5), the oscillator coil 11 performs, as shown in (B) of FIG. 5, the three-frequency synthesized oscillation based on an instruction from the oscillator control unit 15*a*.

A sampling (c) is performed as to the receiving coil 12, as shown in (C) of FIG. 5. Thereafter, the frequency expansion unit 15*e* performs the FFT process based on data collected in the sampling (c). An amplitude value of each designated frequency calculated in the FFT process is used as a measurement value at the position where the coin center coincides with the sensor center.

Thereafter, based on each output of the receiving coil 12, a determination process is implemented by the coin recognition unit 15*f* of the control unit 15, and a transmission process of transmitting a determined result is performed at a predetermined timing.

Returning to FIG. 2, the processing units of the control unit 15 are explained below. The oscillator control unit 15*a* is a processing unit that receives the reference clock from the clock 14 and performs the process of switching the signal applied to the oscillator coil 11 between the single-frequency signal and the synthesized-frequency signal.

Specifically, upon receiving a notification from the timing sensor 13 that the coin 101 is approaching the magnetic sensor, the oscillator control unit 15*a* switches the signal that is applied to the oscillator coil 11 from the single frequency to the synthesized frequency, and switches back to the single frequency after a predetermined number of samples are taken. Furthermore, upon receiving a notification from the coin center detecting unit 15*d* that the coin center is coinciding with the sensor center, the oscillator control unit 15*a* switches the signal that is to be applied to the oscillator coil 11 from the single frequency to the synthesized frequency, and switches back to the single frequency after a predetermined number of samples are taken.

In conjunction with the process described above, the oscillator control unit 15*a* performs a process of changing the frequency of the single-frequency signal, each frequency contained in the synthesized-frequency signal, and the number of frequencies contained in the synthesized-frequency signal, in response to an instruction from a input unit which is not shown in the figures.

The AD (Analog-to-Digital) converting unit 15*b* converts an analog signal that is induced in the receiving coil 12 into a digital signal, and supplies the digital signal to the amplitude calculating unit 15*c* and the frequency expansion unit 15*e*. Similar to the oscillator control unit 15*a*, the AD converting unit 15*b* receives the reference clock from the clock 14.

The amplitude calculating unit 15*c* is a processing unit that calculates a total amplitude value by adding the signals obtained by the two transmissive sensors (the transmissive one-side aligning coil 32 and the transmissive counter-side aligning coil 33). An amplitude calculation process performed by the amplitude calculating unit 15*c* is explained in detail later with reference to FIG. 9. In conjunction with the amplitude calculation process, the amplitude calculating unit 15*c* outputs the calculated amplitude to the coin center detecting unit 15*d* and the coin recognition unit 15*f*.

When the single-frequency signal is applied to the oscillator coil 11, the coin center detecting unit 15*d* receives the signal induced in the receiving coil 12 through the AD converting unit 15*b*, and performs a process of detecting the timing when the coin center coincides with the sensor center based on a changing rate of the amplitude value of the induced signal. The coin center detection process performed by the coin center detecting unit 15*d* is explained with reference to FIG. 6.

Figure 6:
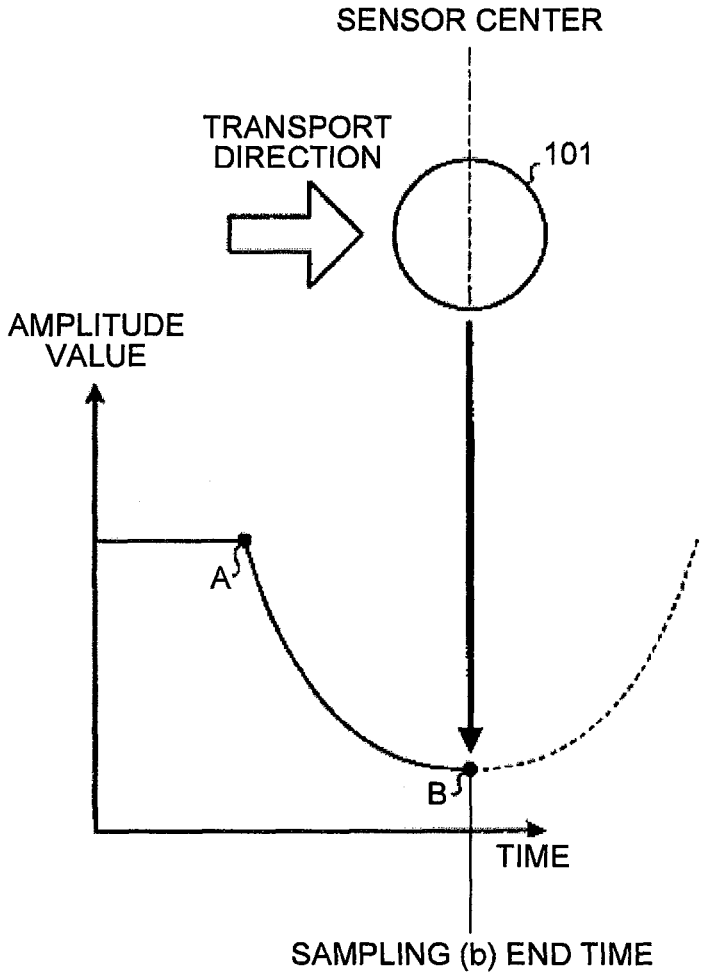
FIG. 6 is a drawing depicting an overview of a coin center detection process.

FIG. 6 is a drawing depicting an overview of the coin center detection process. As shown in FIG. 6, when the coin edge reaches the magnetic sensor (see reference symbol A of FIG. 6), the amplitude value of the induced signal starts falling. When the coin center coincides with the sensor center, the change rate of the amplitude value becomes 0 (see reference symbol B of FIG. 6). The coin center detecting unit 15*d* monitors the change rate of the amplitude values based on the sampling (b) shown in FIG. 5, and detects the timing when the change rate becomes 0, that is, the timing when the monitored amplitude value reaches a minimum value.

Returning to FIG. 2, the frequency expansion unit 15*e* is explained next. The frequency expansion unit 15*e* is a processing unit that, when the synthesized-frequency signal is applied to the oscillator coil 11, receives the signal that is induced in the receiving coil 12 through the AD converting unit 15*b*, and extracts induced signals of each frequency corresponding to the contained frequency in the synthesized-frequency signal by performing the FFT process for expanding the induced signal on the frequency axis. In conjunction with frequency expansion, the frequency expansion unit 15*e* outputs each of the expanded frequency signals to the coin recognition unit 15*f*.

The coin recognition unit 15*f* is a processing unit that performs the process of performing the recognition of the denomination and authenticity of the coin 101 by using the so-called Mahalanobis distance based on the amplitude of the induced signal received from the amplitude calculating unit 15*c* upon application of the single-frequency signal, and the signals of each frequency expanded from the induced frequency received from the frequency expansion unit 15*e* upon application of the synthesized-frequency signal.

The Mahalanobis distance is a distance that takes into account a probability distribution, and is typically used in multivariate analysis in which correlation between variables is used. In the present embodiment, all the voltages of the frequencies detected from all the coils included in the receiving coil 12 shown in FIG. 4, and the amplitudes calculated by the amplitude calculating unit 15*c* are used as variables in the calculation of the Mahalanobis distance. An example in which the denomination is determined by using the Mahalanobis distance is explained below with reference to FIGS. 7A and 7B.

Figure 7A:
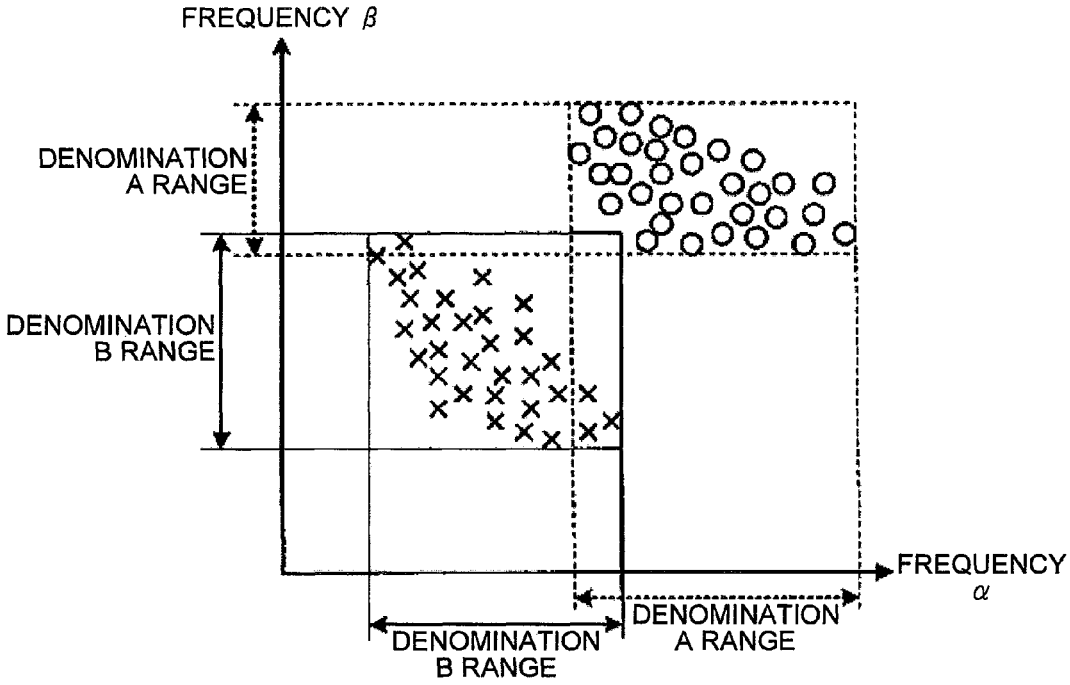
FIGS. 7A and 7B are drawings depicting an example in which a denomination is determined by using the Mahalanobis distance.
Figure 7B:
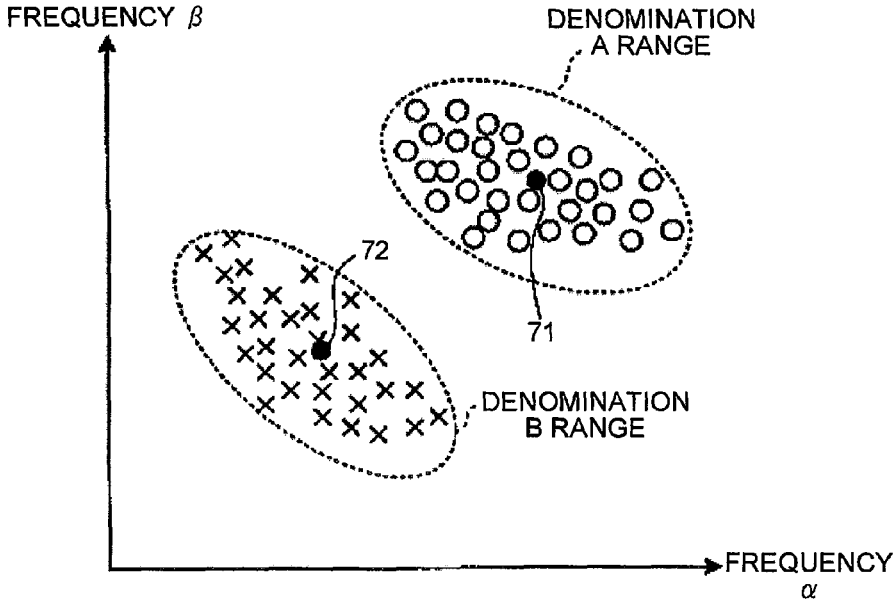

FIGS. 7A and 7B are drawings depicting an example in which the denomination is determined by using the Mahalanobis distance. In FIG. 7A, a case in which the denomination is determined by using a conventional method of using elemental upper and lower threshold values is shown, whereas in FIG. 7B, a case in which the denomination is determined by using the Mahalanobis distance is shown.

In FIGS. 7A and 7B, circles represent sampled data of a denomination A, and crosses represent sampled data of a denomination B. Furthermore, in FIGS. 7A and 7B, a frequency a axis represents various sensor values detected in the receiving coil 12 when a frequency $\alpha$ is applied to the oscillator coil 11, and a frequency $\beta$ axis represents various sensor values detected in the receiving coil 12 when a frequency $\beta$, which is different from the frequency $\alpha$, is applied to the oscillator coil 11.

As shown in FIG. 7A, in the conventional method, a threshold range for the denomination A is set in the frequency $\alpha$ axis and the frequency $\beta$ axis (see "denomination A range" in FIG. 7A), and a threshold range for the denomination B is set in the frequency a axis and the frequency $\beta$ axis (see "denomination B range" in FIG. 7A).

However, as shown in FIG. 7A, the denomination A range and the denomination B range overlap in both the frequency axes $\alpha$ and $\beta$. Thus, the denomination cannot be clearly distinguished in the overlapping region, making a distinction capability for the denomination A and the denomination B inadequate.

On the other hand, in the denomination determination in which the Mahalanobis distance is used, as shown in FIG. 7B, a denomination A range is represented by an area within a predetermined closed curve for a distribution center 71 (see "denomination A range" in FIG. 7B), and a denomination B range is represented by an area within a predetermined closed curve for a distribution center 72 (see "denomination B range" in FIG. 7B). Thus, the distinction capability for the denomination A and the denomination B can be improved by performing the multivariate analysis by using the Mahalanobis distance.

Figure 8:
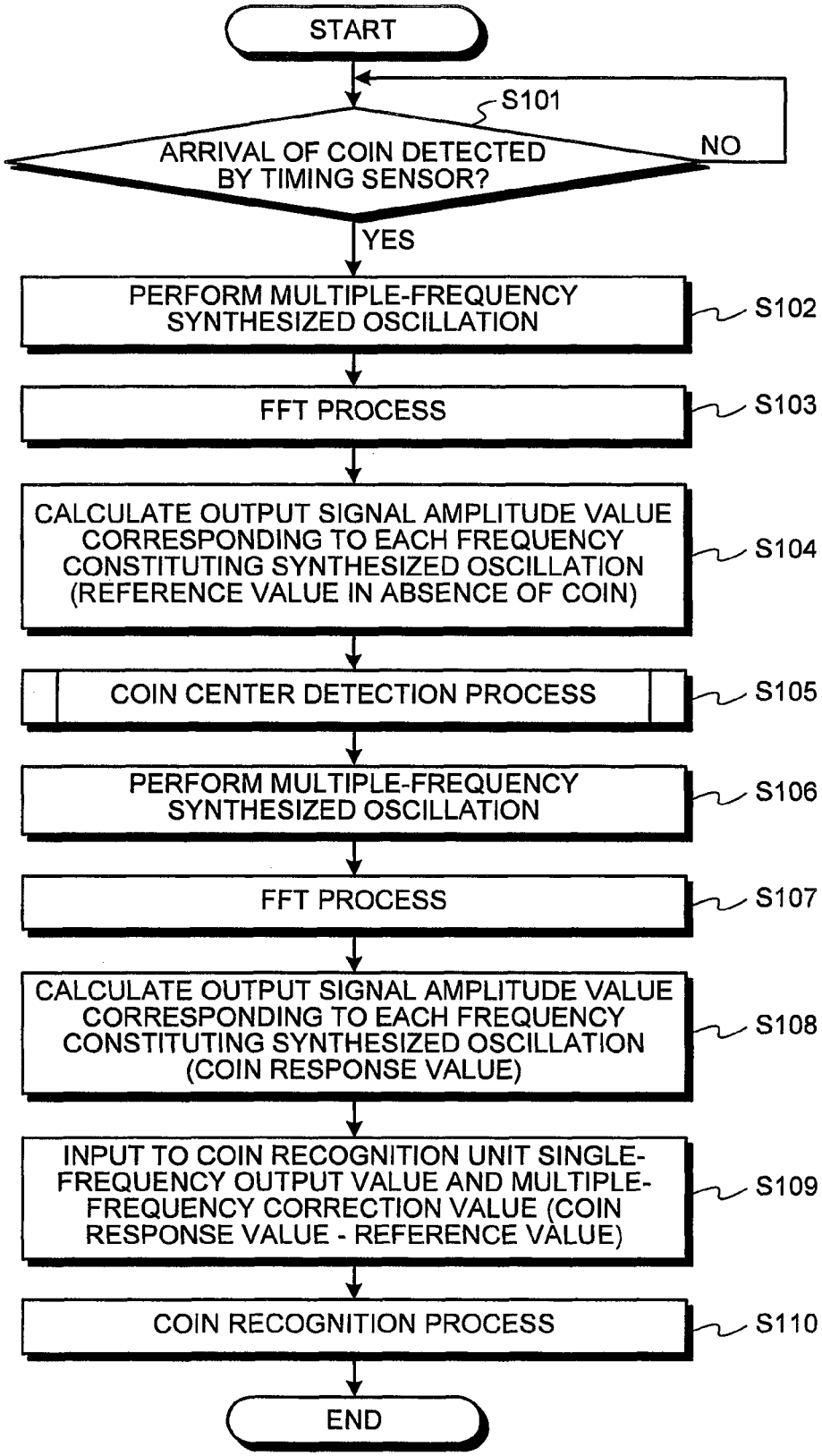
FIG. 8 is a flowchart of a process procedure executed by the coin recognition apparatus.

A process procedure executed by the coin recognition apparatus 10 is explained next with reference to FIG. 8. FIG. 8 is a flowchart of the process procedure executed by the coin recognition apparatus. When the timing sensor 13 detects that the coin has reached (Yes at Step S101), the oscillator control unit 15*a* instructs the oscillator coil 11 to perform a multiple-frequency synthesized oscillation (Step S102). On the other hand, if the decision condition at Step S101 is not satisfied (No at Step S101), Step S101 is repeated.

Upon receiving the signal that is induced in the receiving coil 12 through the AD converting unit 15*b*, the frequency expansion unit 15*e* performs the FFT process (Step S103), and calculates an output signal amplitude value corresponding to each frequency contained in the synthesized oscillation (the reference value in the absence of the coin) (Step S104).

The coin center detecting unit 15*d* performs the coin center detection process to detect the timing when the coin center reaches the sensor center (Step S105). Upon detection the timing, the oscillator control unit 15*a* instructs the oscillator coil 11 to perform the multiple-frequency synthesized oscillation (Step S106). A process procedure performed at Step S105 is explained later in detail with reference to FIG. 9.

Upon receiving the signal that is induced in the receiving coil 12 through the AD converting unit 15*b*, the frequency expansion unit 15*e* performs the FFT process (Step S107), and calculates an output signal amplitude value corresponding to each frequency contained in the synthesized oscillation (coin response value) (Step S108).

The frequency expansion unit 15*e* inputs into the coin recognition unit 15*f* the single-frequency output value calculated at Step S105, and a multiple-frequency correction value obtained by subtracting the reference value calculated in the absence of the coin at Step S104 from the coin response value calculated at Step S108 (Step S109). Thereafter, the coin recognition unit 15*f* performs the coin recognition process (Step S110), and the process procedure ends.

Figure 9:
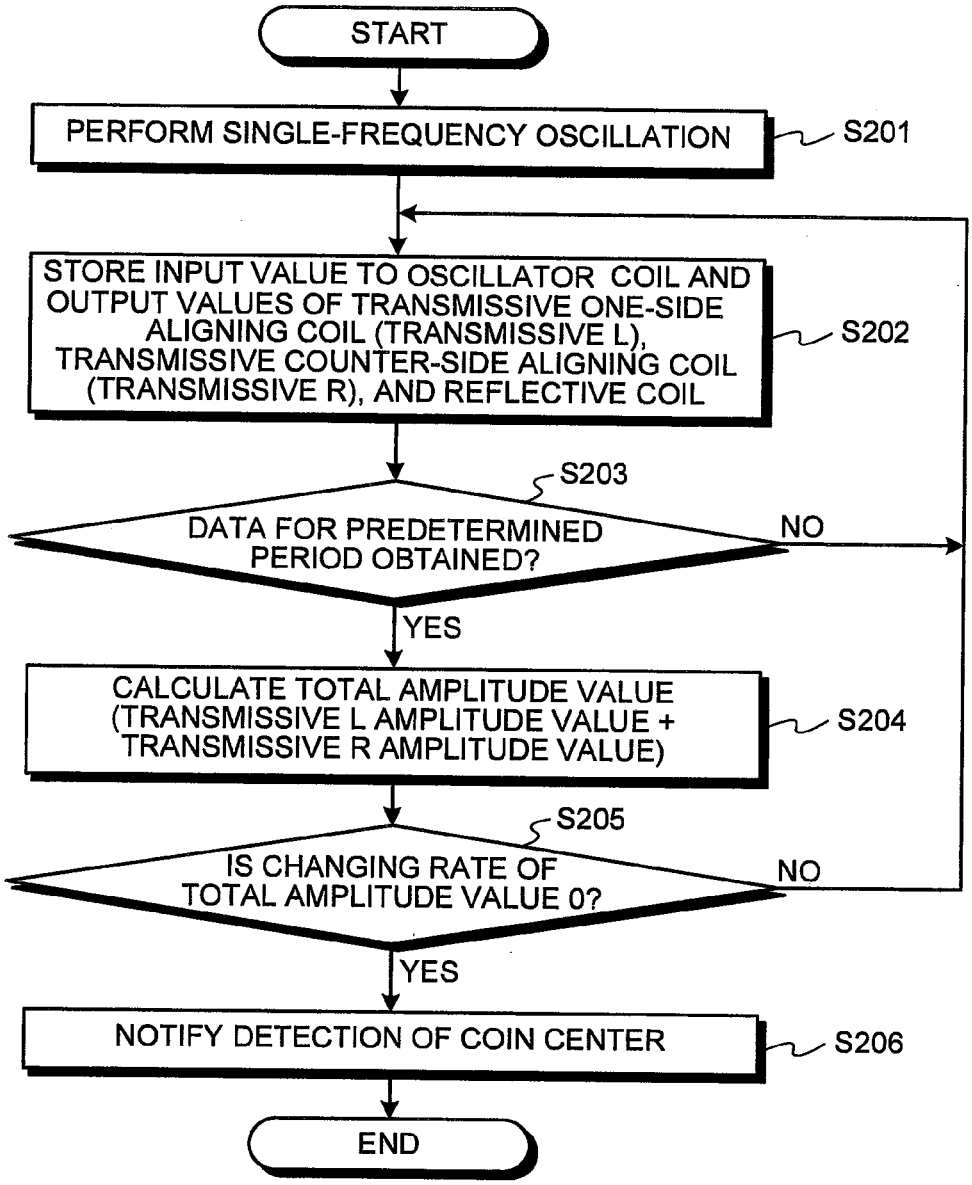
FIG. 9 is a flowchart of the coin center detection process.

The coin center detection process of Step S105 in FIG. 8 is explained in detail with reference to FIG. 9. FIG. 9 is a flowchart of the coin center detection process. As shown in FIG. 9, the oscillator control unit 15*a* instructs the oscillator coil 11 to perform the single-frequency oscillation (Step S201), whereupon the coin center detecting unit 15*d* stores in a memory, such as a ring buffer, an input value to the oscillator coil 31, and output values from the transmissive one-side aligning coil 32 (transmissive L), the transmissive counter-side aligning coil 33 (transmissive R), and the reflective coil 34 (Step S202).

Thereafter, it is determined whether data has been obtained for a predetermined duration (equivalent to a predetermined cycle of a wavelength in use) (Step S203). If data equivalent to the predetermined wavelength has been obtained (Yes at Step S203), the total amplitude value for the data stored at Step S202 (transmissive L amplitude value+transmissive R amplitude value) is calculated (Step S204). If the decision condition at Step S203 is not satisfied (No at Step S203), all the steps from Step S202 are repeated.

The coin center detecting unit 15*d* determines whether the changing rate of the total amplitude value is 0, that is whether the total amplitude value reaches a minimum value, by referring to a history of total amplitude values calculated at Step S204 (Step S205). If the changing rate of the total amplitude value is 0 (Yes at Step S205), the coin center detecting unit 15*d* notifies that the coin center is detected (Step S206), and the process ends. If the decision condition at Step S205 is not satisfied (No at Step S205), all the steps from Step S202 are repeated.

Thus, in the present embodiment, the oscillator control unit applies the synthesized signal containing a plurality of signals of the designated frequencies to the oscillator coil. The AD (Analog-to-Digital) converting unit converts the output signal received from the receiving coil into the digital signal when the synthesized signal is applied to the oscillator coil. The frequency expansion unit expands the digital signal on a frequency axis. The coin recognition unit recognizes a coin based on the amplitude of each signal of the designated frequency extracted from the expanded signal.

The coin recognition apparatus is configured such that the coin center detecting unit detects when the coin center that represents a substantially central line on a surface of the coin reaches the magnetic sensor based on the output signal received from the receiving coil when the single-frequency signal is applied to the oscillator coil, and upon detection of the coin center, the synthesized signal is applied to the oscillator coil. Consequently, the coin recognition process is performed quickly and with a high accuracy without having to increase the scale of the circuitry.

INDUSTRIAL APPLICABILITY

The coin recognition apparatus and the coin recognition method according to the present invention are useful for performing the coin recognition process with a high accuracy without having to increase the scale of the circuitry, and particularly for performing the coin recognition process quickly.

The invention claimed is:

1. A coin recognition apparatus that performs recognition of a coin, being transported, by using a magnetic sensor that detects a signal induced in a receiving coil due to a magnetic field produced by passing a current through an oscillator coil, the coin recognition apparatus comprising:

a synthesized signal applying unit that applies to the oscillator coil a synthesized signal containing signals of a plurality of designated frequencies;

an expansion unit that converts an output signal, which is a signal output from the receiving coil when the synthesized signal is applied to the oscillator coil by the synthesized signal applying unit, into a digital signal and expands the digital signal on a frequency axis;

a coin recognition unit that performs recognition of the coin based on amplitudes of the signals of the designated frequencies extracted from the signals expanded by the expansion unit; and a coin center detecting unit that detects whether a coin center, which represents a substantially central line on a surface of the coin, has reached the magnetic sensor based on the output signal output from the receiving coil when a single-frequency signal is applied to the oscillator coil, wherein the synthesized signal applying unit applies the synthesized signal to the oscillator coil when the coin center is detected by the coin center detecting unit.

2. The coin recognition apparatus according to claim 1, wherein a clock that generates the signals of the designated frequencies applied to the oscillator coil and a clock that converts the output signal from the receiving coil to the digital signal are generated from one and the same clock.

3. The coin recognition apparatus according to claim 1, wherein the signals of the designated frequencies contained in the synthesized signal have frequencies that are not integer multiples of each other.

4. The coin recognition apparatus according to claim 1, wherein the coin recognition unit performs recognition of the coin based on an output signal output from the receiving coil corresponding to a single-frequency signal used by the coin center detecting unit.

5. A coin recognition method for performing recognition of a coin, being transported, by using a magnetic sensor that detects a signal that is induced in a receiving coil due to a magnetic field produced by passing a current through an oscillator coil, the coin recognition method comprising:

detecting whether a coin center, which represents a substantially central line on a surface of the coin, has reached the magnetic sensor based on the output signal output from the receiving coil when a single-frequency signal is applied to the oscillator coil;

applying a synthesized signal containing signals of a plurality of designated frequencies to the oscillator coil when the coin center is detected at the detecting process;

converting an output signal, which is a signal output from the receiving coil when the synthesized signal is applied to the oscillator coil at the applying process, into a digital signal and expanding the output signal on a frequency axis;

recognizing the coin based on amplitudes of the signals of the designated frequencies extracted from the signals expanded at the expanding process.

* * * * *